US012808562B2

(12) United States Patent
Shinoda

(10) Patent No.: US 12,808,562 B2
(45) Date of Patent: Nov. 24, 2026

(54) INFORMATION PROCESSING DEVICE AND AIR CONDITIONING SYSTEM FOR INFERRING PRESSURE STATES

(71) Applicant: Mitsubishi Electric Corporation, Tokyo (JP)

(72) Inventor: Ippei Shinoda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 573 days.

(21) Appl. No.: 18/550,160

(22) PCT Filed: May 17, 2021

(86) PCT No.: PCT/JP2021/018623
§ 371 (c)(1),
(2) Date: Sep. 12, 2023

(87) PCT Pub. No.: WO2022/244061
PCT Pub. Date: Nov. 24, 2022

(65) Prior Publication Data

US 2024/0167716 A1 May 23, 2024

(51) Int. Cl.
*F24F 11/64* (2018.01)
*F24F 11/46* (2018.01)
(Continued)

(52) U.S. Cl.
CPC ..... *F24F 11/64* (2018.01); *F24F 11/46* (2018.01); *F24F 2130/10* (2018.01); *F24F 2140/12* (2018.01)

(58) Field of Classification Search
CPC ..... F25B 2500/19; F25B 2700/1931; F25B 2700/1933; F24F 11/62; F24F 11/30;
(Continued)

(56) References Cited

U.S. PATENT DOCUMENTS 11,526,138 B2 * 12/2022 Gervais ..... G06N 3/084
11,719,477 B2 * 8/2023 Zhang ..... G05B 13/042 62/228.1
(Continued)

FOREIGN PATENT DOCUMENTS

JP 2000-065415 A 3/2000
WO 2013/172327 A1 11/2013

OTHER PUBLICATIONS

International Search Report of the International Searching Authority mailed Jul. 6, 2021 in corresponding International Application No. PCT/JP2021/018623 (and English translation).

*Primary Examiner* — Darrin D Dunn
(74) *Attorney, Agent, or Firm* — Posz Law Group, PLC

(57) ABSTRACT

A first learning device includes a data acquisition unit and a model generation unit. The data acquisition unit includes the data acquisition unit to acquire, as first learning data, information on a weather forecast for an area where a plurality of outdoor units are installed, information on time, information on a frequency of each of a plurality of compressors included in each of the plurality of outdoor units, information on a low pressure of each of the compressors, and information on a high pressure of each of the compressors; and the model generation unit to generate, using the first learning data, a first learned model for inferring the low pressure and the high pressure from the information on the weather forecast and the information on the frequency.

11 Claims, 9 Drawing Sheets

(51) Int. Cl.
*F24F 130/10* (2018.01)
*F24F 140/12* (2018.01)

(58) Field of Classification Search
CPC . F24F 11/64; F24F 11/46; F24F 11/63; G05B 17/02; G05B 13/0265; G05B 13/041; G05B 15/02; G05B 13/04; G05B 19/042; G05B 13/027; G05B 2219/2614; G05B 13/024; G05B 13/048; G05B 23/0243; G05B 23/0254; G05B 23/0275; G06N 5/04; G06N 3/08; G06N 20/00; G06N 3/092
See application file for complete search history.

(56) References Cited

U.S. PATENT DOCUMENTS

| | | | | |
|---|---|---|---|---|
| 2012/0117011 | A1* | 5/2012 | Hashimoto | G05B 13/027 706/23 |
| 2015/0300675 | A1 | 10/2015 | Hamada et al. | |
| 2019/0316794 | A1* | 10/2019 | Song | F24F 11/58 |
| 2020/0229535 | A1* | 7/2020 | Homer | A43B 7/141 |
| 2022/0044179 | A1* | 2/2022 | Tiwari | G06F 16/288 |
| 2022/0178572 | A1* | 6/2022 | Tanaka | F24F 11/80 |
| 2022/0205661 | A1* | 6/2022 | Fujita | F24F 5/00 |
| 2022/0282884 | A1* | 9/2022 | Nishimura | F24F 11/47 |
| 2022/0316741 | A1* | 10/2022 | Nishimura | H04Q 9/00 |

* cited by examiner

FIG.8

FREQUENCY

| POWER CONSUMPTION (kW) (FREQUENCY 15Hz) | | LOW PRESSURE (MPa) | | | | | | |
|---|---|---|---|---|---|---|---|---|
| | | 0.2 | 0.35 | 0.55 | 0.65 | 0.8 | 0.95 | 1.1 |
| HIGH PRESSURE (MPa) | 0.8 | 0.4 | 0.4 | 0.6 | 0.6 | 0.6 | 0.6 | 0.6 |
| | 1.4 | 0.6 | 0.8 | 0.8 | 0.8 | 0.9 | 1.1 | 1.3 |
| | 2.0 | 1.0 | 1.1 | 1.1 | 1.1 | 1.1 | 1.2 | 1.2 |
| | 2.6 | 1.2 | 1.3 | 1.3 | 1.3 | 1.3 | 1.3 | 1.3 |
| | 3.2 | 1.4 | 1.5 | 1.6 | 1.6 | 1.6 | 1.6 | 1.6 |
| | 3.8 | 1.5 | 1.7 | 1.8 | 1.9 | 1.9 | 1.9 | 1.9 |

(kW)

FIG.9

| OPERATION PATTERN | TOTAL FREQUENCY: 120 Hz | |
|---|---|---|
| | SYSTEM Sa | SYSTEM Sb |
| PATTERN A | 120Hz | 0Hz |
| PATTERN B | 105Hz | 15Hz |
| PATTERN C | 104Hz | 16Hz |
| PATTERN D | 103Hz | 17Hz |
| ⋮ | ⋮ | ⋮ |
| PATTERN X | 16Hz | 104Hz |
| PATTERN Y | 15Hz | 105Hz |
| PATTERN Z | 0Hz | 120Hz |

INFORMATION PROCESSING DEVICE AND AIR CONDITIONING SYSTEM FOR INFERRING PRESSURE STATES

CROSS REFERENCE TO RELATED APPLICATION

This application is a U.S. national stage application of PCT/JP2021/018623 filed on May 17, 2021, the contents of which are incorporated herein by reference.

TECHNICAL FIELD

The present disclosure relates to an information processing device and an air conditioning system.

BACKGROUND ART

Some large-scale air conditioning systems installed in a large store, an office building, or the like use a plurality of outdoor units installed outdoors (such as on a roof) of a building to circulate and supply a refrigerant to an indoor unit disposed indoors of the building to perform indoor cooling and heating (see, for example, Japanese Patent Laying-Open No. 2000-65415).

CITATION LIST

Patent Literature

PTL 1: Japanese Patent Laying-Open No. 2000-65415

SUMMARY OF INVENTION

Technical Problem

In general, an outdoor unit is provided with a compressor, and a capacity (air conditioning capacity) of the outdoor unit can be adjusted by adjusting a frequency of the compressor. Therefore, in the air conditioning system including the plurality of outdoor units, the capacity of the entire air conditioning system can be adjusted by deciding the outdoor unit whose compressor is to be operated and adjusting a level of the frequency of the relevant compressor.

However, operation efficiency of the outdoor unit can vary depending on various outdoor environments such as weather, a wind direction, a wind speed, and an air temperature even if the frequency is constant. Therefore, if operation of the outdoor unit is controlled without considering these outdoor environments, there is a concern that a power loss occurs due to the operation of the outdoor unit with poor operation efficiency.

The present disclosure has been made to solve the above-described problem, and an object thereof is to facilitate efficient operation of an air conditioner including a plurality of outdoor units in consideration of an outdoor environment.

Solution to Problem

An information processing device according to the present disclosure is an information processing device of an air conditioner including a plurality of outdoor units including a plurality of compressors respectively, the information processing device including: a first acquisition unit to acquire, as first learning data, information on a weather forecast for an area where the plurality of outdoor units are installed, information on a frequency of each of the plurality of compressors, information on a first pressure that is a refrigerant pressure before compression by each of the plurality of compressors, and information on a second pressure that is a refrigerant pressure after the compression by each of the plurality of compressors; and a first generation unit to generate, using the first learning data, a first model for inferring the first pressure and the second pressure from the information on the weather forecast and the information on the frequency.

Advantageous Effects of Invention

According to the present disclosure, an air conditioner including a plurality of outdoor units can be efficiently operated in consideration of an outdoor environment.

BRIEF DESCRIPTION OF THE DRAWINGS

FIG. 8 is a diagram illustrating one example of a power consumption table.

FIG. 9 is a diagram illustrating one example of a pattern table.

DESCRIPTION OF EMBODIMENTS

Figure 1:
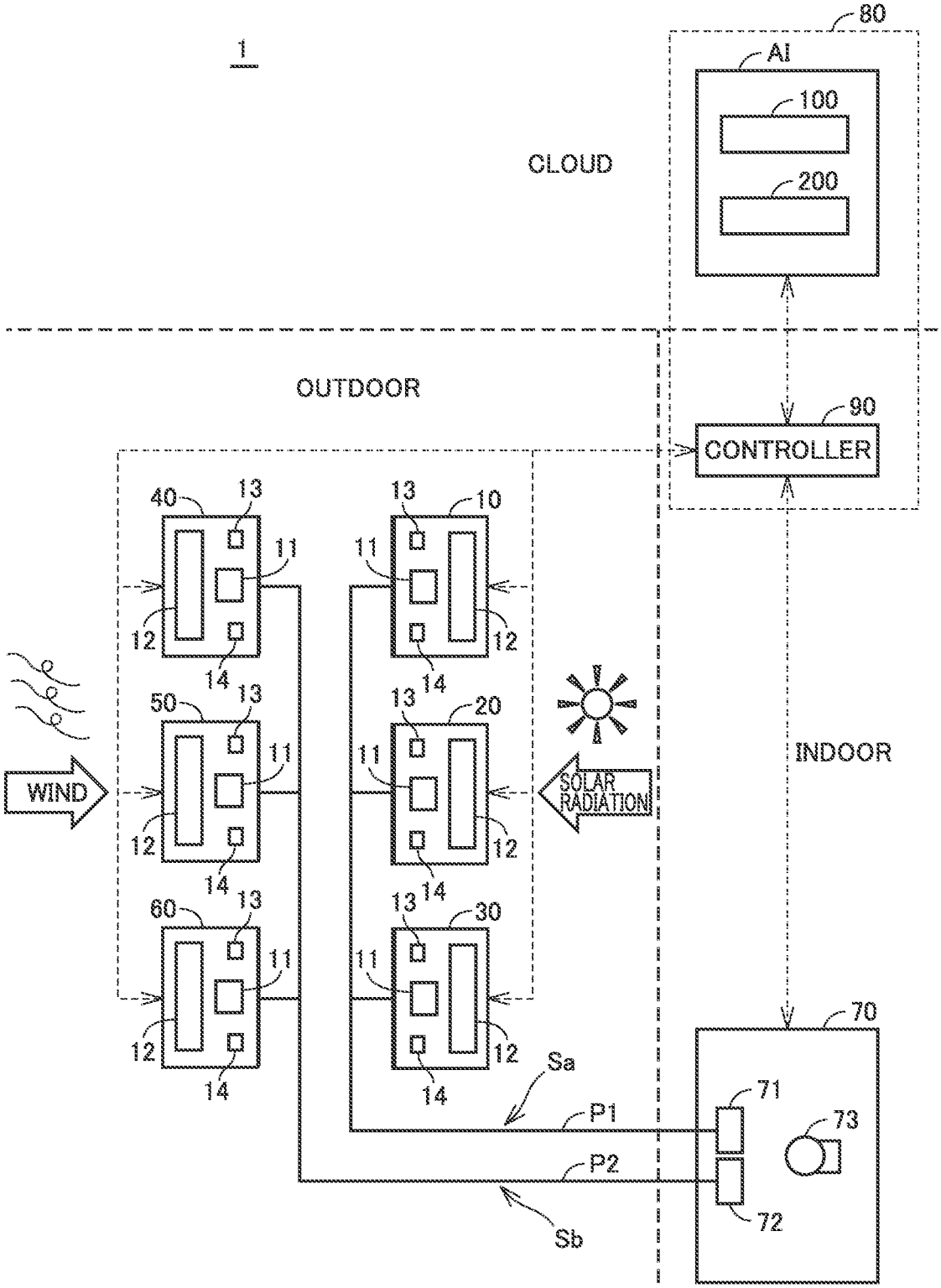
FIG. 1 is a schematic diagram illustrating one example of a configuration of an air conditioning system.

Hereinafter, referring to the drawings, embodiments of the present disclosure will be described in detail. Hereinafter, a plurality of embodiments will be described, but appropriate combination of configurations described in each of the embodiments is scheduled from the beginning of the application. Note that in figures, the same or corresponding units are denoted by the same reference signs, and description thereof will not be repeated.

FIG. 1 is a schematic diagram illustrating one example of a configuration of an air conditioning system 1 according to the present embodiment. Air conditioning system 1 includes a plurality of outdoor units 10 to 60, an indoor unit 70, and an information processing device 80. Information processing device 80 includes a controller 90 and an artificial intelligence device AI.

Indoor unit 70 is disposed indoors of a building to be air-conditioned. Indoor unit 70 includes heat exchangers 71, 72 and a fan 73.

The plurality of outdoor units 10 to 60 are heat source units to obtain heat sources for air conditioning (for cooling or heating). A refrigerant as a heat source is supplied from outdoor units 10 to 60 to indoor unit 70. The plurality of outdoor units 10 to 60 are disposed outdoors of a building in which indoor unit 70 is disposed. Each of outdoor units 10 to 60 includes a compressor 11 and a heat exchanger 12. By operating each of compressors 11, the refrigerant circulates between heat exchanger 12 of each of outdoor units 10 to 60 and heat exchangers 71, 72 of indoor unit 70. As a result, indoor air conditioning is performed.

Each of outdoor units 10 to 60 further includes pressure sensors 13, 14. Pressure sensor 13 detects a refrigerant pressure before compression by compressor 11 (hereinafter, also referred to as "low pressure"). Pressure sensor 14 detects a refrigerant pressure after the compression by compressor 11 (hereinafter, also referred to as "high pressure"). Detection results of pressure sensors 13, 14 are sent to controller 90.

Air conditioning system 1 according to the present embodiment includes two refrigerant systems Sa, Sb that form independent refrigeration cycles. In refrigerant system Sa, the refrigerant circulates between outdoor units 10, 20, 30 and heat exchanger 71 via piping P1. In refrigerant system Sb, the refrigerant circulates between outdoor units 40, 50, 60 and heat exchanger 72 via piping P2.

Controller 90 is disposed, for example, indoors of the building in which indoor unit 70 is disposed. Artificial intelligence device AI is disposed, for example, in a cloud server provided at a place away from the building in which indoor unit 70 is disposed. Note that the disposition of controller 90 and artificial intelligence device AI is not limited to the above disposition. For example, controller 90 may be disposed in the cloud server, or artificial intelligence device AI may be disposed indoors of the building in which indoor unit 70 is disposed.

Controller 90 and artificial intelligence device AI are configured to be able to communicate with each other. Controller 90 intensively manages and controls refrigerant systems Sa, Sb.

Artificial intelligence device AI learns information necessary for control of air conditioning system 1 by controller 90, and outputs the information obtained by a learning result to controller 90. Artificial intelligence device AI includes a learning device 100 and an inference device 200.

Learning device 100 performs "first learning" for generating a first learned model to infer the low pressure and the high pressure of each of compressors 11 from an outdoor environment in which outdoor units 10 to 60 are installed. Furthermore, learning device 100 performs "second learning" for generating a second learned model to infer a total value of frequencies of compressors 11 of the plurality of outdoor units 10 to 60 (hereinafter, also referred to as "total frequency of compressors 11" or simply "total frequency") from the outdoor environment in which outdoor units 10 to 60 are installed.

Inference device 200 infers the low pressure and the high pressure of each of compressors 11 using the first learned model. Further, inference device 200 infers the total frequency of compressors 11 using the second learned model.

Controller 90 controls air conditioning system 1 on the basis of the low pressure, the high pressure of each of compressors, and the total frequency of compressors 11 inferred by inference device 200.

[Learning by Artificial Intelligence Device AI]

As described above, air conditioning system 1 according to the present embodiment includes the plurality of outdoor units 10 to 60 each including compressor 11. Therefore, in air conditioning system 1, a capacity of entire air conditioning system 1 can be adjusted by deciding the outdoor unit whose compressor 11 is to be operated and adjusting the frequency of the relevant compressor.

However, operation efficiency of outdoor units 10 to 60 can vary depending on various outdoor environments such as weather, a wind direction, a wind speed, and an air temperature. Specifically, a power consumption of each of compressors 11 included in outdoor units 10 to 60 can fluctuate in accordance with the low pressure and the high pressure even if the operation frequency (rotation speed) is the same, and the low pressure and the high pressure of compressor 11 can fluctuate in accordance with the outdoor environment in which the compressor 11 is installed. In particular, between the outdoor units in which directions of surfaces on which heat exchangers 12 are disposed are different from each other, a solar radiation amount and an air volume that impinge on heat exchangers 12 are greatly different, and thus, the operation efficiency can be greatly different in accordance with the outdoor environment. Therefore, if operations of outdoor units 10 to 60 are controlled without considering the outdoor environments there is a concern that a power loss occurs due to the operation of the outdoor units with poor operation efficiency.

Consequently, in air conditioning system 1 according to the present embodiment, the low pressure and the high pressure of each of compressors 11 are inferred from the outdoor environment in which outdoor units 10 to 60 are installed, and the power consumption of each of compressors 11 is calculated (predicted) using an inference result. Air conditioning system 1 performs an operation with high operation efficiency by using a prediction result of the power consumption of each of compressors 11. For example, only one of the refrigerant systems may be operated such that refrigerant system Sa operates at 60% of a maximum capacity and refrigerant system Sb operates at 0% (thermo-off) of the maximum capacity, or the operation may be operated by making different a capacity ratio between both the refrigerant systems such that refrigerant system Sa is operated at 60% of the maximum capacity and refrigerant system Sb is operated at 20% of the maximum capacity. As a result, air conditioning system 1 can be efficiently operated in consideration of the outdoor environment in which outdoor units 10 to 60 are installed.

Furthermore, the refrigerant system or compressor 11 having a small integrated operation time may be preferentially operated as long as the efficiency is the same at any capacity ratio. As a result, the operation time of compressor 11 can be equalized.

Hereinafter, learning by artificial intelligence device AI will be described in detail by being divided into a learning phase and a utilization phase.

<Learning Phase>

Figure 2:
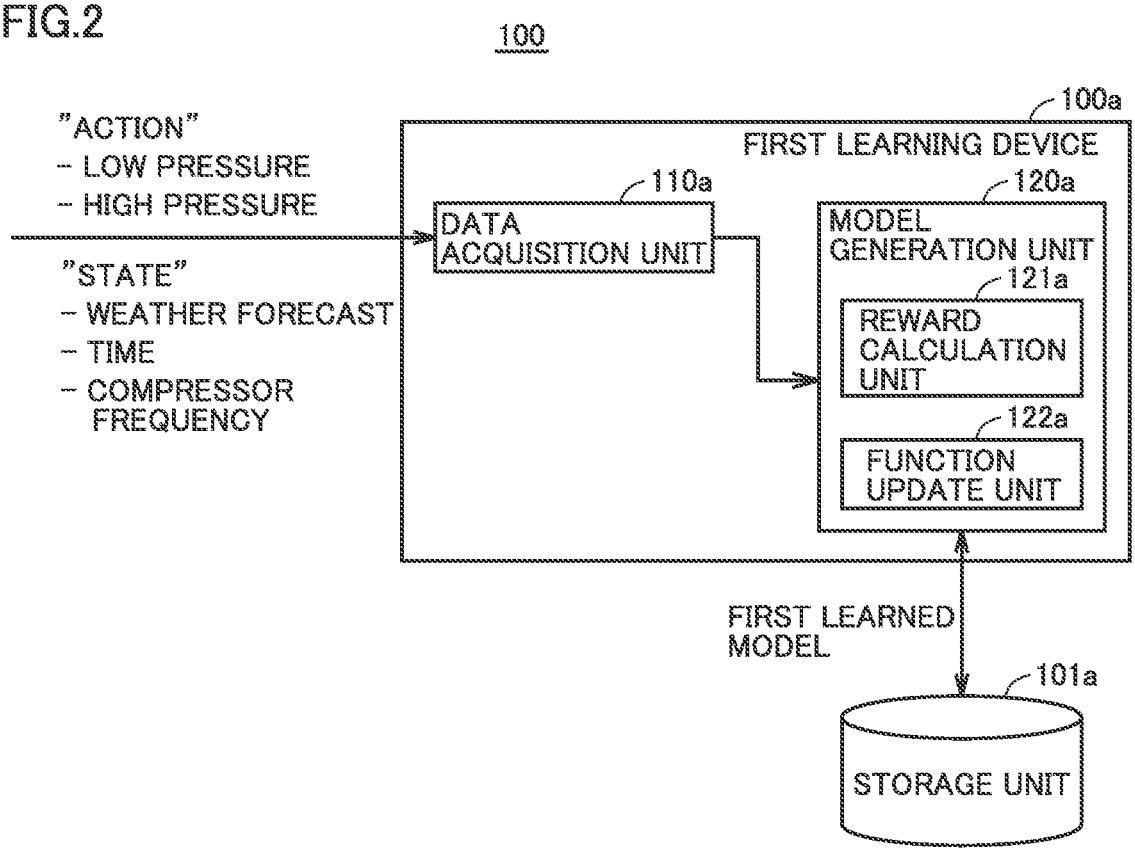
FIG. 2 is a functional block diagram of a portion related to first learning in a learning device.

FIG. 2 is a functional block diagram of a portion related to the first learning in learning device 100 of artificial intelligence device AI. Learning device 100 includes a first learning device 100*a* to perform the first learning for generating the first learned model and a storage unit 101*a* to store the first learned model. Note that FIG. 2 illustrates an example in which storage unit 101*a* is provided outside first learning device 100*a*, but storage unit 101*a* may be provided inside first learning device 100*a*.

First learning device 100*a* includes a data acquisition unit 110*a* and a model generation unit 120*a*. Data acquisition unit 110*a* acquires, as first learning data, information on a weather forecast for an area where outdoor units 10 to 60 are installed (information such as the weather, the wind direction, the wind speed, and the air temperature), information on time, information on the frequency of each of compressors 11, and information on the low pressure and the high pressure of each of compressors 11.

Among the information acquired by data acquisition unit 110*a*, the information on "weather forecast" and "time" is information on the outdoor environment in which outdoor units 10 to 60 are installed, and is acquired from an outside of air conditioning system 1, for example, through the Internet. The information on "weather forecast" includes information such as the weather (fine, cloudy, rainy, cloud cover, etc.), the wind direction, the wind speed, and the air temperature. Note that the information on the "weather" is information correlated with the solar radiation amount in the daytime, and the information on the "time" is information correlated with presence or absence of solar radiation and a solar radiation angle.

Among the information acquired by data acquisition unit 110*a*, the information on the "frequency", the "low pressure", and the "high pressure" is operation information of each of compressors 11, and is acquired from, for example, controller 90. Note that in general, the power consumption of compressor 11 is correlated with the frequency, the low pressure, and the high pressure. In other words, they are related such that if the frequency, the low pressure, and the high pressure of compressor 11 are determined, the power consumption of compressor 11 is also determined.

Model generation unit 120*a* generates the first learned model for inferring the low pressure and the high pressure of each of compressors 11 from the information on the weather forecast, the information on the time, and the information on the frequency of each of compressors 11. Storage unit 101*a* stores the first learned model generated by model generation unit 120*a*.

As a learning algorithm used by model generation unit 120*a*, a known algorithm such as supervised learning, unsupervised learning, or reinforcement learning can be used. As one example, a case where the reinforcement learning is applied will be described. In the reinforcement learning, an agent (action subject) in a certain environment observes a current state (environmental parameter) and determines an action to be taken. The environment dynamically changes in accordance with the action of the agent, and a reward is given to the agent in accordance with the change of the environment. The agent repeats this, and learns an action policy that maximizes the reward through a series of actions. As representative methods of the reinforcement learning, Q-learning and TD-learning are known. For example, in the case of Q-learning, a general update formula of an action-value function Q(s, a) is expressed by formula (1).

[Mathematical Formula 1]

$$Q(s_t, a_t) \leftarrow Q(s_t, a_t) + \alpha\left(r_{t+1} + \gamma \max_a Q(s_{t+1}, a) - Q(s_t, a_t)\right) \quad (1)$$

In formula (1), $s_t$ represents a state of the environment at a time t, and $a_t$ represents an action at time t. Action at changes the state to $s_t+1$. $r_t+1$ represents a reward given by a change in the state, $\gamma$ represents a discount rate, and $\alpha$ represents a learning coefficient. Note that $\gamma$ is in a range of $0<\gamma\leq 1$, and $\alpha$ is in a range of $0<\alpha\leq 1$.

In the present embodiment, the information on the weather forecast, the information on the time, and the information on the frequency of each of compressors 11 are set as state $s_t$, and the information on the low pressure and the high pressure of each of compressors 11 is set as action $a_t$, and a best action $a_t$ in state $s_t$ at time t is learned.

The update formula expressed by formula (1) increases an action value Q when action value Q of an action a having a highest Q value at a time t+1 is larger than action value Q of action a executed at time t, and decreases action value Q in the opposite case. In other words, action-value function Q (s, a) is updated so that action value Q of action a at time t approaches the best action value at time t+1. As a result, the best action value in a certain environment sequentially propagates to the action value in the previous environment.

As described above, in a case where a learned model is generated by the reinforcement learning, model generation unit 120*a* includes a reward calculation unit 121*a* and a function update unit 122*a*.

Reward calculation unit 121*a* calculates the reward on the basis of the "action" and the "state" described above. Reward calculation unit 121*a* calculates a reward r on the basis of a reward standard (generic name of a reward increase standard and a reward decrease standard described later). For example, in a case where the reward increase standard is satisfied, the reward is increased (for example, a reward of "1" is given), and on the other hand, in a case where the reward decrease standard is satisfied, the reward is reduced (for example, a reward of "−1" is given).

In the present embodiment, the reward increase standard is set so as to give a higher reward as a divergence degree between a detection value of the low pressure (output of each of pressure sensors 13) and an inference value by the first learned model decreases, and as a divergence degree between a detection value of the high pressure (output of each of pressure sensors 14) and an inference value by the first learned model decreases. That is, model generation unit 120*a* performs reinforcement learning in which a higher reward is given as the divergence degree between the detection values of the low pressure and the high pressure, and the inference values by the first learned model decreases.

In addition, the reward decrease standard is set so as to give a lower reward as the divergence degree between the detection value of the low pressure, and the inference value by the first learned model increases, and as the divergence degree between the detection value of the high pressure and the inference value by the first learned model increases. That is, model generation unit 120*a* performs the reinforcement learning in which a lower reward is given as the divergence degree between the detection values of the low pressure and the high pressure and the inference values by the first learned model increases.

Function update unit 122*a* updates a function for determining an "output" in accordance with the reward calculated by reward calculation unit 121*a*. For example, in the case of Q-learning, an action-value function Q (st, at) expressed by formula (1).

The above learning is repeatedly executed. Storage unit 101*a* stores, as the first learned model, the action-value function Q (st, at) updated by function update unit 122*a*.

Figure 3:
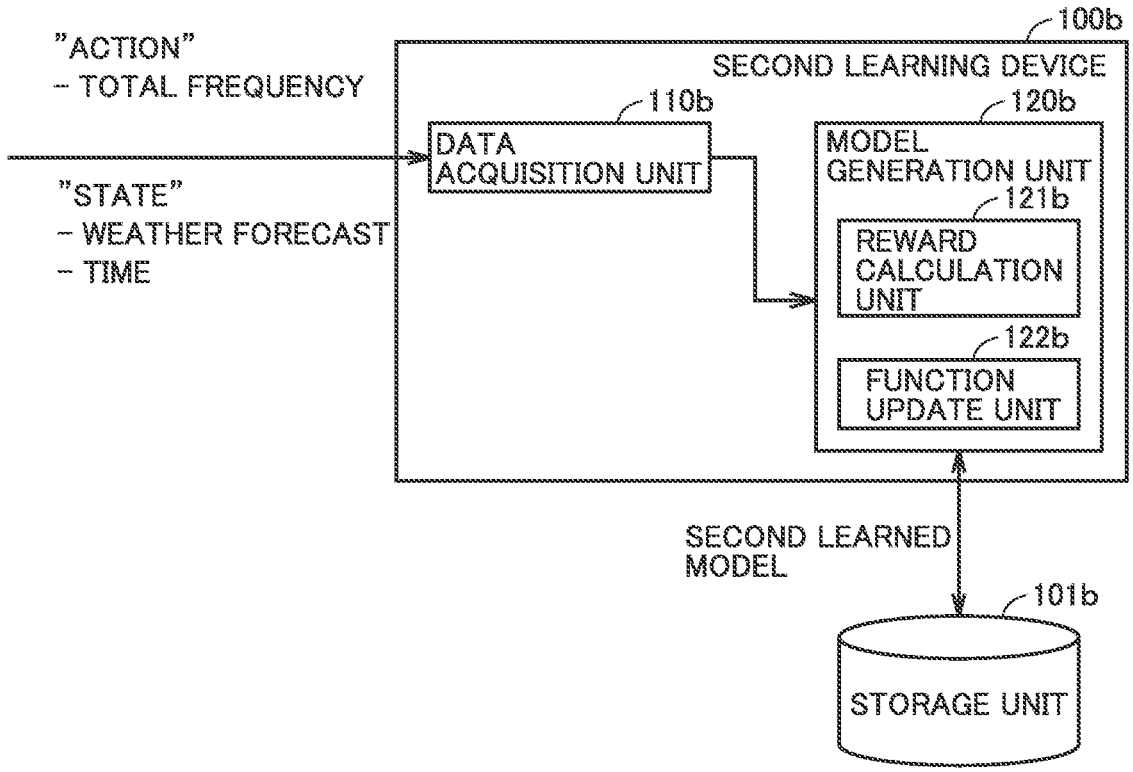
FIG. 3 is a functional block diagram of a portion related to second learning in the learning device.

FIG. 3 is a functional block diagram of a portion related to the second learning in learning device 100 of artificial intelligence device AI. Learning device 100 includes a second learning device 100*b* to perform the second learning for generating the second learned model and a storage unit 101*b* to store the second learned model.

Second learning device 100*b* includes a data acquisition unit 110*b* and a model generation unit 120*b*. Data acquisition unit 110*b* acquires, as second learning data, the information on the weather forecast for the area where outdoor units 10 to 60 are installed (information such as the weather, the wind direction, the wind speed, and the air temperature), the information on the time, and the information on the total frequency of compressors 11.

Model generation unit 120*b* generates the second learned model for inferring the total frequency of compressors 11 from the information on the weather forecast, and the information on the time. Storage unit 101*b* stores the second learned model generated by model generation unit 120*b*.

Since an algorithm similar to that of model generation unit 120*a* can be used as the learning algorithm used by model generation unit 120*b*, the detailed description of the learning algorithm used by model generation unit 120*b* will not be repeated here. When the reinforcement learning is used as the learning algorithm used by model generation unit 120*b*, model generation unit 120*b* includes a reward calculation unit 121*b* and a function update unit 122*b*. In formula (1) above, model generation unit 120*b* may learn best action $a_t$ in state $s_t$ at time t with the information on the weather forecast and the information on the time as the state $s_t$ and the information on the total frequency of compressors 11 as action $a_t$.

Figure 4:
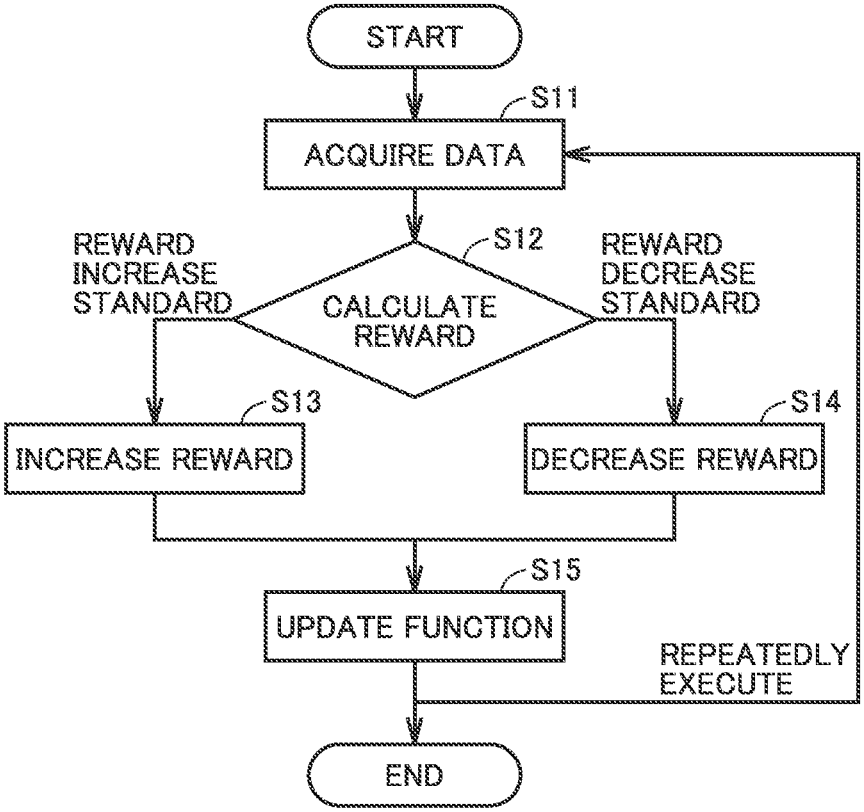
FIG. 4 is a flowchart illustrating one example of a processing procedure executed when the learning device performs the first learning.

FIG. 4 is a flowchart illustrating one example of a processing procedure executed when first learning device 100*a* performs the first learning using the reinforcement learning algorithm. Note that when second learning device 100*b* performs the second learning using the reinforcement learning algorithm, processing similar to the processing illustrated in FIG. 4 is also executed, and thus the detailed description of the flowchart of the second learning will not be repeated.

First, data acquisition unit 110*a* of first learning device 100*a* acquires the "action" and the "state" as learning data (step S11). In the first learning, as described above, the information on the low pressure and the high pressure of each of compressors 11 is the "action", and the information on the weather forecast, the information on the time, and the information on the frequency of each of compressors 11 are the "state". Note that in the second learning, as described above, the total frequency of compressors 11 is the "action", and the information on the weather forecast and the information on the time are the "state".

Next, model generation unit 120*a* of first learning device 100*a* calculates the reward on the basis of the "action" and the "state" (step S12). Specifically, model generation unit 120*a* of first learning device 100*a* acquires the "action" and "state", and determines whether to increase the reward or to reduce the reward on the basis of the predetermined reward standard.

In a case where it is determined in step S12 that the reward is to be increased, model generation unit 120*a* of first learning device 100*a* increases the reward (step S13). On the other hand, in a case where it is determined in step S12 that the reward is to be decreased, model generation unit 120*a* of first learning device 100*a* decreases the reward (step S14).

Then, model generation unit 120*a* of first learning device 100*a* updates action-value function Q (st, at) expressed by formula (1) on the basis of the calculated reward (step S15).

First learning device 100*a* repeatedly executes the processing from steps S11 to S15 described above, and stores generated action-value function Q (st, at) in storage unit 101*a* as the first learned model.

<Utilization Phase>

Inference device 200 of artificial intelligence device AI includes a first inference device 200*a* to infer and output the low pressure and the high pressure of each of compressors 11 using the first learned model generated by the first learning of the learning phase, and a second inference device 200*b* to infer and output the total frequency of compressors 11 using the second learned model generated by the second learning of the learning phase.

Figure 5:
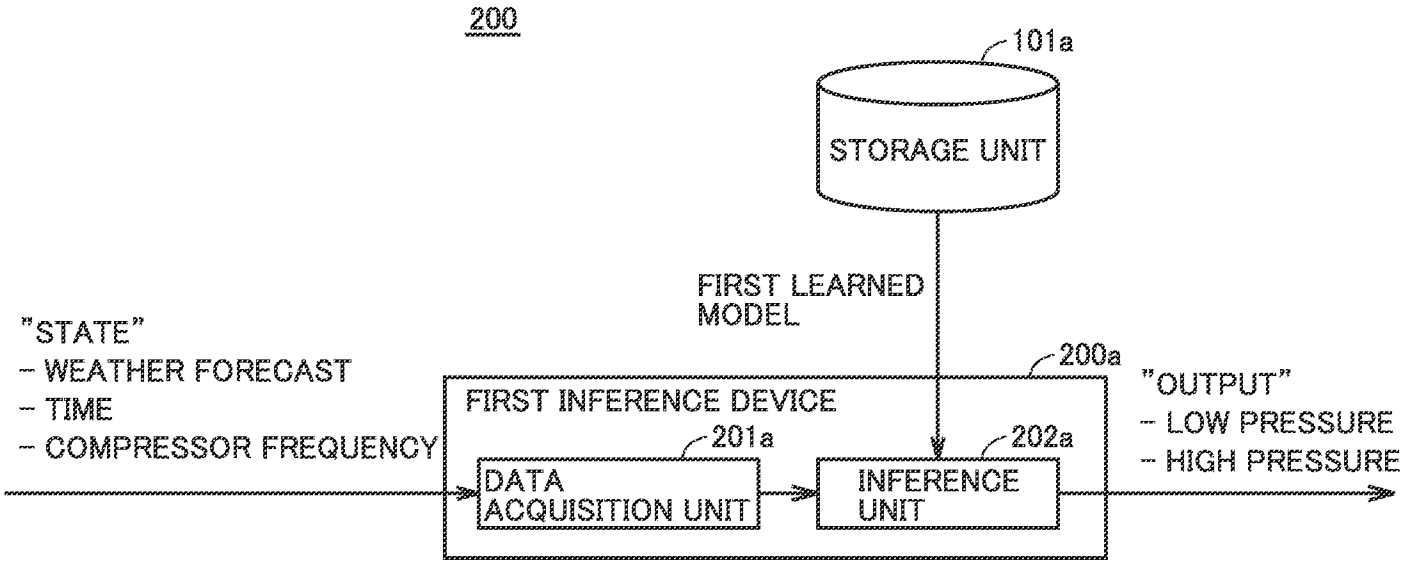
FIG. 5 is a configuration diagram of a first inference device.

FIG. 5 is a configuration diagram of first inference device 200*a*. First inference device 200*a* includes a data acquisition unit 201*a* and an inference unit 202*a*. Note that FIG. 5 illustrates an example of a case where the first learned model is generated by the reinforcement learning.

Data acquisition unit 201*a* acquires the information on the weather forecast, the information on the time, and the information on the frequency of each of compressors 11 as the "state". Inference unit 202*a* infers the low pressure and the high pressure of each of compressors 11 as the "output" using the first learned model stored in storage unit 101*a*. By inputting the "state" acquired by data acquisition unit 201*a* to the first learned model, it is possible to infer the "output" suitable for the "state".

Figure 6:
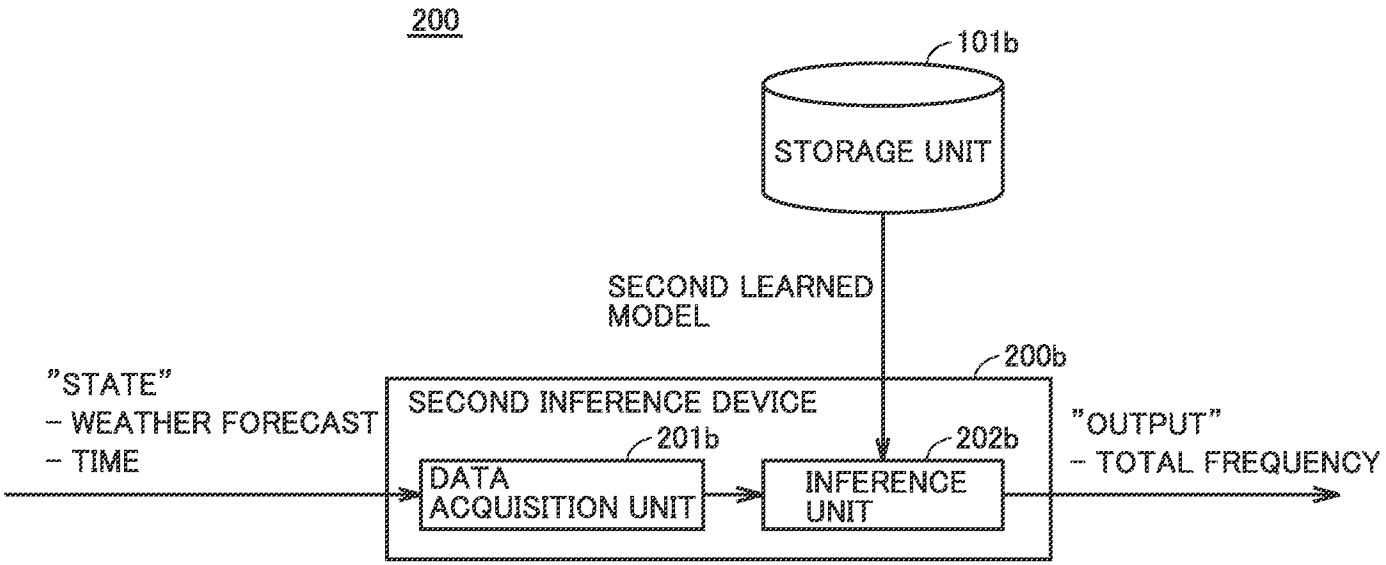
FIG. 6 is a configuration diagram of a second inference device.

FIG. 6 is a configuration diagram of second inference device 200*b*. Second inference device 200*b* includes a data acquisition unit 201*b* and an inference unit 202*b*. Note that FIG. 6 illustrates an example of a case where the second learned model is generated by the reinforcement learning.

Data acquisition unit 201*b* acquires the information on the weather forecast and the information on the time as the "state". Inference unit 202*b* infers the total frequency of compressors 11 as the "output" using the second learned model stored in storage unit 101*b*. By inputting the "state" acquired by data acquisition unit 201*b* to the second learned model, it is possible to infer the "output" suitable for the "state".

Controller 90 controls air conditioning system 1 on the basis of the low pressure and the high pressure of each of compressors 11 inferred by first inference device 200*a*, and the total frequency of compressors 11 inferred by second inference device 200*b*.

Figure 7:
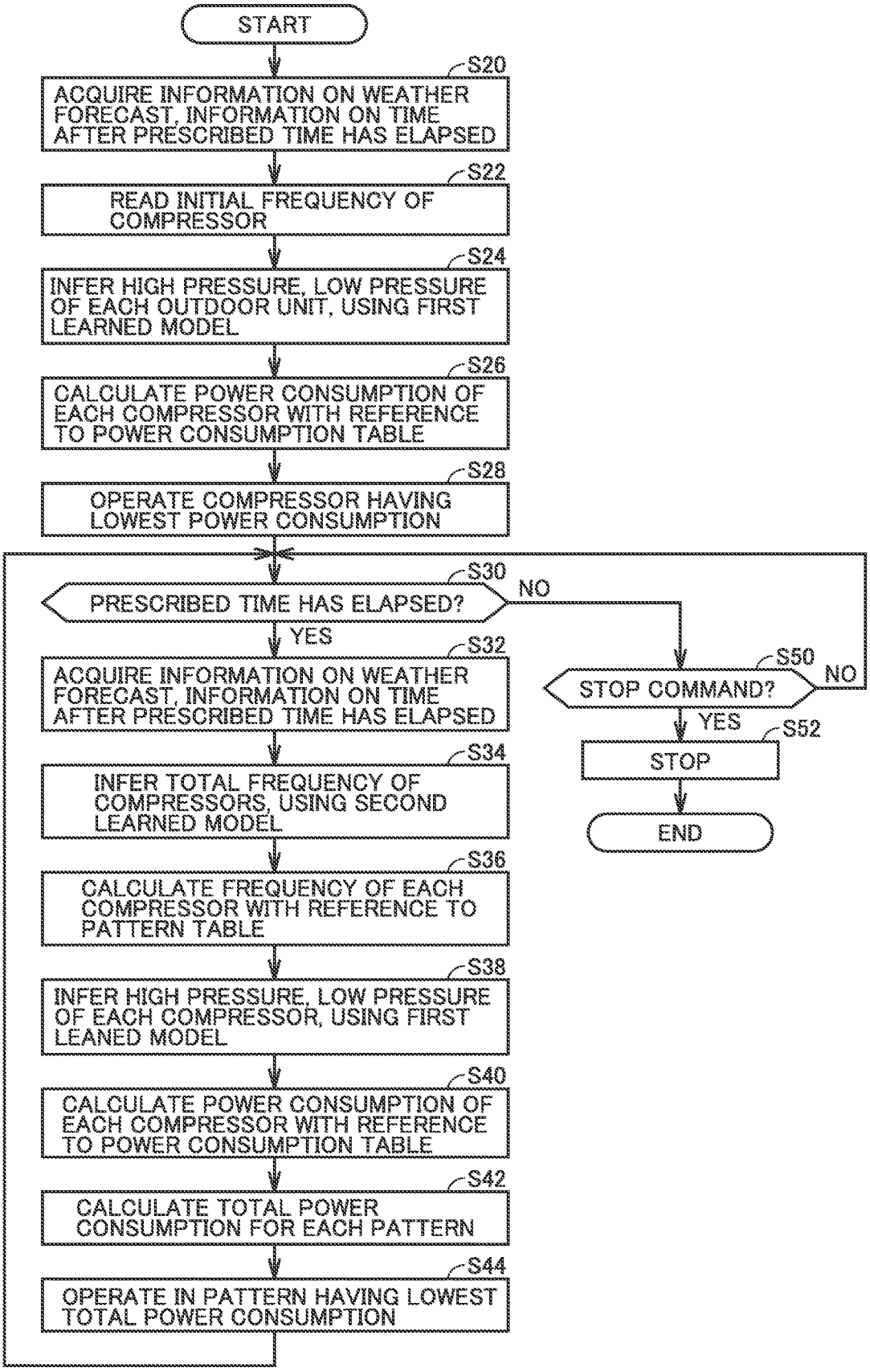
FIG. 7 is a flowchart illustrating one example of a processing procedure executed by the first inference device, the second inference device, and a controller in a utilization phase.

FIG. 7 is a flowchart illustrating one example of a processing procedure executed by first inference device 200*a*, second inference device 200*b*, and controller 90 in the utilization phase. This flowchart is started when air conditioning system 1 is activated (switched from a stopped state to an operating state).

In response to a request from controller 90, first inference device 200*a* acquires the information on the weather forecast and the information on the time after a prescribed time has elapsed (for example, after several minutes) since a current point of time (step S20).

Subsequently, first inference device 200*a* reads an initial frequency of the compressor 11 stored in a memory (not illustrated) (step S22). Note that the initial frequency is determined in advance and stored in the memory (not illustrated) on the assumption that any one of the plurality of outdoor units 10 to 60 is operated when air conditioning system 1 is activated. First inference device 200*a* reads this initial frequency from the memory.

Subsequently, first inference device 200*a*, using the first learned model, infers the high pressure and the low pressure of each of compressors 11 after the prescribed time has elapsed from the information on the weather forecast and the information on the time acquired in step S20, and the initial frequency read in step S22 (step S24). The inferred high pressure and low pressure of each of compressors 11 are sent to controller 90.

Upon receiving the high pressure and the low pressure from first inference device 200*a*, controller 90 refers to a power consumption table stored in a memory (not illustrated) and calculates the power consumption of each of compressors 11 when each of compressors 11 is operated at the initial frequency (step S26).

FIG. 8 is a diagram illustrating one example of the power consumption table referred to in step S26. In the power consumption table, a correspondence relationship among the low pressure (unit: MPa), the high pressure (unit: MPa), and the power consumption (unit: kW) of each of compressors 11 is defined for each of compressors 11 and for each of the frequencies (unit: Hz) of compressors 11. FIG. 8 illustrates the power consumption table in a case where the frequency is 15 hz in a certain compressor 11.

As illustrated in FIG. 8, the power consumption of compressor 11 may vary depending on the low pressure and the high pressure even at the same frequency (15 Hz). The low pressure and the high pressure of compressor 11 can vary depending on the outdoor environment in which compressor 11 is installed.

Therefore, controller 90 calculates the power consumption corresponding to the high pressure and the low pressure inferred in step S24 and the initial frequency read in step S22 for each compressor 11 with reference to the power consumption table illustrated in FIG. 8.

Returning to FIG. 7, controller 90 specifies compressor 11 having the lowest power consumption from the calculation result in step S26, and operates specified compressor 11 at the initial frequency (step S28). As a result, air conditioning system 1 can be efficiently activated in consideration of influence by the outdoor environment.

Subsequently, controller 90 determines whether or not the prescribed time has elapsed since the time of activation (step S30). If the prescribed time has not elapsed since the time of activation (NO in step S30), controller 90 determines whether or not a stop command has been received from a user or another system (step S50). When the stop command is not received (NO in step S50), controller 90 returns the processing to step S30 and waits until the prescribed time elapses.

When controller 90 determines that the prescribed time has elapsed since the time of activation (YES in step S30), second inference device 200*b* acquires, in response to a request from controller 90, the information on the weather forecast and the information on the time after the prescribed time has further elapsed since the current point of time (step S32).

Subsequently, second inference device 200*b* infers the total frequency of compressors 11 after the prescribed time has elapsed, using the second learned model from the information on the weather forecast and the information on the time acquired in step S32 (step S34). The inferred total frequency is sent to controller 90.

Upon receiving the total frequency from second inference device 200*b*, controller 90 refers to a pattern table stored in the memory (not illustrated) and calculates the frequency of each of compressors 11 for each of a plurality of operation patterns (step S36).

FIG. 9 is a diagram illustrating one example of the pattern table referred to in step S36. In the pattern table, a plurality of operation patterns A to Z for allocating the total frequency inferred in step S34 to refrigerant system Sa and refrigerant system Sb at different ratios from each other are prescribed in advance. FIG. 9 illustrates the pattern table in a case where the total frequency inferred in step S34 is 120 Hz.

For example, in a pattern A, all of the total frequency of 120 Hz is allocated to refrigerant system Sa, and no frequency is allocated to refrigerant system Sb. That is, pattern A is a pattern in which the total frequency of three compressors 11 included in refrigerant system Sa is set to 120 Hz and the operation of refrigerant system Sb is stopped. In addition, in a pattern B, 105 Hz of the total frequency 120 Hz is allocated to refrigerant system Sa, and the remaining 15 Hz is allocated to refrigerant system Sb.

Controller 90 calculates the frequency of each of compressors 11 for each of the plurality of operation patterns A to Z by allocating the total frequency inferred in step S34 with reference to the pattern table illustrated in FIG. 9. For example, for pattern A, the frequency of each of three compressors 11 included in refrigerant system Sa is set to 40 Hz (=120 Hz/3), and the frequency of each of three compressors 11 included in refrigerant system Sb is set to 0 Hz (=0 Hz/3). In addition, for pattern B, the frequency of each of three compressors 11 included in refrigerant system Sa is set to 35 Hz (=105 Hz/3), and the frequency of each of three compressors 11 included in refrigerant system Sb is set to 5 Hz (=15 Hz/3).

Note that in the present embodiment, it is assumed that the frequency allocated to each of the refrigerant systems is equally allocated to three compressors 11 included in each of the refrigerant systems. However, each of the patterns may be further subdivided so that allocation ratios to compressors 11 included in each of the refrigerant systems are different.

The frequency of each of compressors 11 for each of the operation patterns calculated in step S36 is sent to first inference device 200*a*.

First inference device 200*a*, using the first learned model, infers the high pressure and the low pressure of each of compressors 11 after the prescribed time has further elapsed since the current point of time from the information on the weather forecast and the information on the time acquired in step S32, and the frequency of each of compressors 11 for each of the operation patterns calculated in step S36 (step S38). The inferred high pressure and low pressure are sent to controller 90.

Upon receiving the high pressure and the low pressure from first inference device 200*a*, controller 90 again refers to the above-described power consumption table illustrated in FIG. 8, and calculates the power consumption of each of compressors 11 (step S40). Note that a method for calculating the power consumption using the power consumption table is the same as the method described in step S26 described above.

Subsequently, controller 90 uses a calculation result of step S40 to calculate a total power consumption of compressors 11 for each of the operation patterns A to Z (step S42).

Subsequently, controller 90 specifies the operation pattern having the lowest total power consumption from a calculation result in step S42, and operates each of compressors 11 in the specified operation pattern (step S44). Accordingly, even after the activation of air conditioning system 1, air conditioning system 1 can be efficiently operated in consideration of the influence by the outdoor environment.

Note that after the processing in step S44, controller 90 returns the processing to step S30 and repeatedly executes the processing in step S30 and later.

As described above, in the learning phase, information processing device 80 according to the present embodiment generates the first learned model for inferring the low pressure and the high pressure of each of compressors 11 from the information on the outdoor environment (weather forecast and time) in the area where the plurality of outdoor units 10 to 60 are installed and the information on the frequency of each of compressors 11. The low pressure and the high pressure of compressor 11 are inferred using this first learned model, and the power consumption of each of compressors 11 can be predicted on the basis of the inference result. As a result, air conditioning system 1 can be efficiently operated in consideration of the outdoor environment.

Furthermore, in the learning phase, information processing device 80 according to the present embodiment generates the second learned model for inferring the total frequency of compressors 11 from the information on the outdoor environment (weather forecast and time) described above.

Then, in the utilization phase, information processing device 80 according to the present embodiment uses the second learned model to infer the frequency of each of compressors 11, and uses the first learned model to infer the low pressure and the high pressure of each of compressors 11 corresponding to the frequency of each of compressors 11 inferred using the second learned model, and the information on the outdoor environment (weather forecast and time).

Then, information processing device 80 according to the present embodiment calculates the power consumption of each of the compressors 11 from the inferred frequency, low pressure, and high pressure of each of compressors 11, and operates air conditioning system 1 with compressor 11 or in the operation pattern having the lowest power consumption. As a result, air conditioning system 1 can be efficiently operated in consideration of the outdoor environment in which outdoor units 10 to 60 are installed.

[Modifications]

In the above-described embodiment, an example in which the initial frequency stored in the memory is read in step S22 of FIG. 7 has been described, but artificial intelligence device AI may infer the initial frequency from the outdoor environment in step S22 of FIG. 7.

In the above-described embodiment, one compressor 11 having the lowest power consumption is operated when air conditioning system 1 is activated (steps S22 to S28 in FIG. 7), but air conditioning system 1 may be also operated in the operation pattern having the lowest power consumption at the time of activation as in steps S32 to S44 in FIG. 7.

In the above-described embodiment, one example in which artificial intelligence device AI infers the total frequency of compressors 11 from the outdoor environment using the second learned model has been described. However, for example, controller 90 may calculate the total frequency by referring to a table or the like.

In the above embodiment, the example in which the information on both the "weather forecast" and the "time" is included as the information on the outdoor environment for the area has been described, but for example, only the "weather forecast" may be included as the information on the outdoor environment.

It should be considered that the embodiments disclosed this time are examples in all respects and are not restrictive. The scope of the present disclosure is defined not by the description above but by the claims, and it is intended that all modifications within meaning and scope equivalent to the claims are included.

REFERENCE SIGNS LIST

1: air conditioning system, 10 to 60: outdoor unit, 11: compressor, 12, 71, 72: heat exchanger, 13, 14: pressure sensor, 70: indoor unit, 73: fan, 80: information processing device, 90: controller, 100: learning device, 100*a*: first learning device 100*b*: second learning device, 101*a*, 101*b*: storage unit, 110*a*, 110*b*, 201*a*, 201*b*: data acquisition unit, 120*a*, 120*b*: model generation unit, 121*a*, 121*b*: reward calculation unit, 122*a*, 122*b*: function update unit, 200: inference device, 200*a*: first inference device, 200*b*: second inference device, 202*a*, 202*b*: inference unit, AI: artificial intelligence device, P1, P2: piping, Sa, Sb: refrigerant system

The invention claimed is:

1. An information processing device of an air conditioner including a plurality of outdoor units including a plurality of compressors respectively, the information processing device comprising:

at least one processor configured to acquire, in a first acquiror, as first learning data, information on a weather forecast for an area where the plurality of outdoor units are installed, information on a frequency of each of the plurality of compressors, information on a first pressure that is a refrigerant pressure before compression by each of the plurality of compressors, and information on a second pressure that is a refrigerant pressure after the compression by each of the plurality of compressors;

generate, in a first model generator, using the first learning data, a first model configured to infer the first pressure and the second pressure from the information on the weather forecast and the information on the frequency;

perform a first inference, using the first model to predict the first pressure and the second pressure from the information on the weather forecast and the information on the frequency;

determine an operation pattern of the plurality of compressors on a basis of power consumptions of the plurality of compressors regarding the first pressure and the second pressure which are predicted; and operate the plurality of compressors based on the operation pattern having a lowest total value of the power consumptions of the plurality of compressors.

2. The information processing device according to claim 1, further comprising a first sensor to detect the first pressure, and a second sensor to detect the second pressure, wherein the first model generator performs reinforcement learning in which a reward is determined on a basis of a divergence degree between an output of the first sensor and an inference value of the first pressure by the first model, and a divergence degree between an output of the second sensor and an inference value of the second pressure by the first model.

3. The information processing device according to claim 1, further comprising a control unit to control the plurality of compressors, wherein the control unit calculates power consumptions of the plurality of compressors on a basis of a prediction result by the first inference, and determines an operation pattern of the plurality of compressors on a basis of a calculation result of the power consumptions of the plurality of compressors.

4. The information processing device according to claim 1, wherein the at least one processor is further configured to acquire, in a second acquiror, as second learning data, the information on the weather forecast and information on a total value of frequencies of the plurality of compressors; and generate, in a second model generator, using the second learning data, a second model for inferring the total value of the frequencies from the information on the weather forecast.

5. The information processing device according to claim 4, wherein the at least one processor is further configured to perform a second inference, using the second model, to predict the total value of the frequencies from the information on the weather forecast.

6. The information processing device according to claim 5, further comprising a control unit to control the plurality of compressors, wherein the control unit sets a plurality of operation patterns in each of which the total value of the frequencies matches a prediction result by the second inference, calculates the total value of the power consumptions of the plurality of compressors for each of the plurality of operation patterns on a basis of a prediction result by the first inference, and operates the plurality of compressors in an operation pattern having a lowest total value of the power consumptions of the plurality of compressors, the plurality of operation patterns being different from each other in frequency allocation.

7. An air conditioning system comprising:

the air conditioner; and the information processing device according to claim 1.

8. An information processing device of an air conditioner including a plurality of outdoor units including a plurality of compressors respectively, the information processing device comprising:

at least one processor configured to acquire, in a first acquiror, as first learning data, information on a weather forecast for an area where the plurality of outdoor units are installed, information on a frequency of each of the plurality of compressors, information on a first pressure that is a refrigerant pressure before compression by each of the plurality of compressors, and information on a second pressure that is a refrigerant pressure after the compression by each of the plurality of compressors;

generate, in a first model generator, using the first learning data, a first model configured to infer the first pressure and the second pressure from the information on the weather forecast and the information on the frequency;

acquire, in a second acquiror, as second learning data, the information on the weather forecast and information on a total value of frequencies of the plurality of compressors;

generate, in a second model generator, using the second learning data, a second model configured to infer a total value of the frequencies of the plurality of compressors from the information on the weather forecast;

perform a first inference using the first model to predict the first pressure and the second pressure from the information on the weather forecast and the information on the frequency;

perform a second inference using the second model to predict the total value of the frequencies from the information on the weather forecast;

set a plurality of operation patterns in each of which the total value of the frequencies matches a prediction result of the second inference;

calculate the total value of power consumptions of the plurality of compressors for each of the plurality of operation patterns on a basis of the prediction result by the first inference; and operate the plurality of compressors in an operation pattern having a lowest total value of the power consumptions of the plurality of compressors, the plurality of operation patterns being different from each other in frequency allocation.

9. The information processing device according to claim 8, further comprising a first sensor to detect the first pressure, and a second sensor to detect the second pressure, wherein the first model generator performs reinforcement learning in which a reward is determined on a basis of a divergence degree between an output of the first sensor and an inference value of the first pressure by the first model, and a divergence degree between an output of the second sensor and an inference value of the second pressure by the first model.

10. The information processing device according to claim 8, further comprising a control unit to control the plurality of compressors, wherein the control unit calculates power consumptions of the plurality of compressors on a basis of a prediction result by the first inference, and determines an operation pattern of the plurality of compressors on a basis of a calculation result of the power consumptions of the plurality of compressors.

11. An air conditioning system comprising:

the air conditioner; and the information processing device according to claim 8.

* * * * *